United States Patent [19]

Lapp et al.

[11] 4,379,837

[45] Apr. 12, 1983

[54] PROCESS FOR THE PREPARATION OF SILVER HALIDE EMULSIONS, PHOTOGRAPHIC MATERIALS, AND A PROCESS FOR THE PRODUCTION OF PHOTOGRAPHIC IMAGES

[75] Inventors: Otto Lapp; Harald von Rintelen; Franz Moll, all of Leverkusen-Bayerwerk; Lothar Endres, Bergisch Gladbach, all of Fed. Rep. of Germany

[73] Assignee: Agfa-Gevaert Aktiengesellschaft, Leverkusen, Fed. Rep. of Germany

[21] Appl. No.: 265,535

[22] Filed: May 20, 1981

[30] Foreign Application Priority Data

May 23, 1980 [DE] Fed. Rep. of Germany ..... 3019733

[51] Int. Cl.[3] ..... G03C 1/02

[52] U.S. Cl. ..... 430/434; 430/543; 430/569; 430/564; 430/568

[58] Field of Search ..... 430/568, 569, 543, 564, 430/567, 574, 434

[56] References Cited

U.S. PATENT DOCUMENTS

| | | | |
|---|---|---|---|
| 3,206,313 | 9/1965 | Porter et al. | 430/564 |
| 3,661,592 | 5/1972 | Phillippaerts et al. | 430/568 |
| 3,704,130 | 11/1972 | Pollet et al. | 430/568 |
| 3,847,617 | 11/1974 | Phillippaerts et al. | 430/568 |
| 3,976,492 | 8/1976 | Hinata et al. | 430/574 |
| 4,297,439 | 10/1981 | Bergthaller et al. | 430/569 |
| 4,298,683 | 11/1981 | Becker et al. | 430/569 |

*Primary Examiner*—Won H. Louie, Jr.

*Attorney, Agent, or Firm*—Connolly and Hutz

[57] ABSTRACT

Silver halide emulsions are prepared by precipitating a silver halide emulsion I on a more sparingly soluble silver halide emulsion II in the presence of a silver halide solvent wherein the emulsion I has been prepared in the presence of a compound inhibiting grain growth.

10 Claims, No Drawings

PROCESS FOR THE PREPARATION OF SILVER HALIDE EMULSIONS, PHOTOGRAPHIC MATERIALS, AND A PROCESS FOR THE PRODUCTION OF PHOTOGRAPHIC IMAGES

This invention relates to a novel process for the preparation of silver halide emulsions in which emulsions differing in their solubility are mixed and redissolved. The invention also relates to a photographic material and to a process for the production of photographic images.

Silver halide emulsions are generally prepared by precipitation of silver halide in a binder, preferably gelatine. This precipitation may be carried out by adding an aqueous solution of a silver salt to a halide solution in gelatine. The size of the silver halide grains obtained is controlled by, inter alia, the temperature of the solution, the time taken to pour in the silver salt solution and the amount of excess of halide.

The size and distribution of the silver halide grains in the emulsion obtained are also influenced to a large extent by the so-called Ostwald ripening, by which is meant the dissolving of more readily soluble silver halide grains followed by their deposition on more sparingly soluble silver halide grains under the action of silver halide solvents.

It is also known to pour the aqueous solutions of a silver salt and of a halide simultaneously into a receiver (double jet process).

It is also known to prepare silver halide emulsions by mixing emulsions which differ in their grain size and redissolving them in the presence of silver halide solvents. One precondition for such a process is that the silver halide crystals used for dissolving and recrystallising should differ in their solubilities. Differences in solubility can be obtained by using different grain sizes and/or different halide compositions. Methods of this type have been disclosed in U.S. Pat. Nos. 2,146,938, 3,206,313 and 3,317,322; German Auslegeschrift No. 1,207,791; the report by D. Marcocki and W. Romer in "Korpuluskar Photographie" IV (1963), pages 149 et seq and "Zhurnal Nauchnoi Prikladnoi Fotografi Kinematografi" 5, No. 2 (1960), pages 81–83. These processes of recrystallisation are carried out in the presence of silver halide solvents. The more readily soluble silver halide emulsion used in these processes is preferably a fine grained silver halide emulsion having an average particle diameter smaller than that of the more sparingly soluble silver halide emulsion.

It is also known to prepare fine grained silver halide emulsions by precipitating silver halide in the presence of compounds which inhibit the growth of the silver halide grains. Reference may be made to, for example, U.S. Pat. Nos. 3,704,130, 3,874,617, 3,661,592 and Belgian Pat. No. 710,602.

The advantages of the processes of recrystallisation indicated above lie, inter alia, in the controlled Ostwald ripening obtained and, above all, in the avoidance of localised supersaturation with silver ions.

It is an object of this invention to provide an improved process for the preparation of silver halide emulsions.

A new process for the preparation of a silver halide emulsion has been found, in which a fine grained silver halide emulsion used as starting material is mixed with a comparatively sparingly soluble silver emulsion and the fined grained emulsion is redissolved and precipitated on the more sparingly soluble emulsion. The fine grained silver halide emulsion used as starting material is hereinafter referred to as emulsion I and the comparatively sparingly soluble silver halide emulsion as emulsion II.

According to the invention, (1) the silver halide emulsion I is prepared by reaction of a water-soluble silver salt with a water-soluble halide in the presence of a compound which inhibits the growth of silver halide grains, and (2) redissolving and precipitating of emulsion I on emulsion II are carried out in the presence of a silber halide solvent.

Light sensitive photographic silver halide materials have been found, in which emulsions prepared in such a manner are contained in at least one layer on a support layer.

Furthermore, a process for the production of photographic images has been found, in which a photographic recording material according to the invention is exposed imagewise and developed.

There are no fundamental restrictions as regards the compounds which inhibit grain growth according to the invention. Suitable are especially compounds which are strongly adsorbed by the silver halide grains and which do not form a soluble complex with silver or silver halide. The following compounds, for example, may be used:

1. Compounds corresponding to the following general formula I:

$$Z—A—X \qquad \text{I}$$

disclosed in U.S. Pat. No. 3,704,130 in which formula Z and X, which may be the same or different, represent a heterocyclic group, a substituted heterocyclic group or a heterocyclic group with condensed ring attached, said heterocyclic group containing a=N group, and A represents a single chemical bond, an alkylene group which may be interrupted by an oxygen atom or by a —N(R) group, in which R represents a hydrogen atom or an alkyl group having not more than 4 carbon-atoms, an arylene group, an alkenylene group or a S-alkylene-S or S-alkylene group, in which the alkylene groups may be interrupted by an oxygen atom or by a —N(R) group in which R has the same meaning as above. Preferred compounds are compounds of U.S. Pat. No. 3,704,130.

2. Purine bases, e.g. adenine.

3. Optical sensitizers for silver halide, especially compounds which sensitize the blue region of the spectrum. Suitable compounds are for example, the compounds of U.S. Pat. No. 3,976,492. Especially preferred compounds are represented by the following formula II.

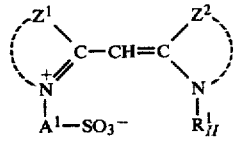

II

In the formula (III), $Z^1$ represents a group of atoms necessary to complete a benzothiazole nucleus or a napthothiazole nucleus and $Z^2$ represents a group of atoms necessary to complete a napthothiazole nucleus. $A^1$ represents an alkylene group having 4 or less carbon atoms which can be substituted with a hydroxyl group (for example, an ethylene group, a 1,3-propylene group, a 1,4-butylene group or a 2-hydroxy-1,3-butylene group etc.), $R_{II}^1$ represents an $—A^2—SO_3H$ group or an $—A^2—CO_2H$ group, wherein $A^2$ has the same meaning as $A^1$, and $A^1$ and $A^2$ can be the same or different.

4. Compounds of the formula III

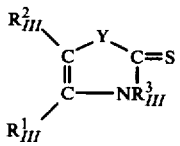

III

Optionally these compounds may be present in the tautomeric form

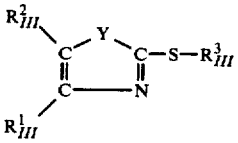

in which

Y represents —O—, —S— or $—NR_{III}^4—$ $R_{III}^1$, $R_{III}^2$ which may be the same or different represent H, alkyl with 1–4 carbon atoms, especially methyl, aryl, especially phenyl or together the atoms for completing an annulated aromatic system, which may be substituted especially the atoms for completing a phenyl or napthyl ring. Suitable substituents are $—NH_2$, $SO_3H$ and Cl.

$R_{III}^3$ represents H or an alkylene group substituted by a N-containing 5- or 6-membered heterocyclic ring, e.g. the group

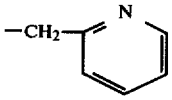

$R_{III}^4$ represents an alkyl rest, especially with 1–4 carbon atoms, e.g. methyl or an aryl rest, especially phenyl or H.

Preferred compounds used according to the invention are shown in Table 1.

TABLE 1

| No. | Compound |
|---|---|
| 1.1 | Adenine |
| 1.2 | 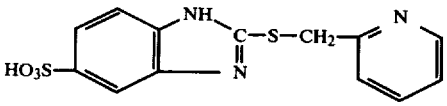 |
| 1.3 | 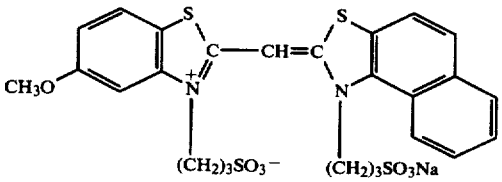 |

TABLE 1-continued

| No. | Compound |
|---|---|
| 1.4 | 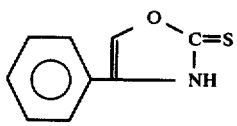 |
| 1.5 | 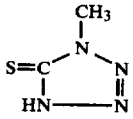 |
| 1.6 | 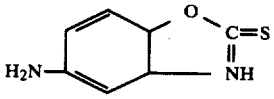 |
| 1.7 | 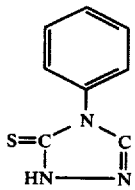 |
| 1.8 | 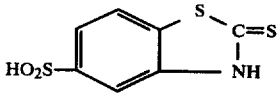 |
| 1.9 | 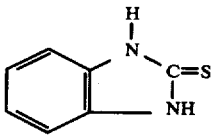 |
| 1.10 | 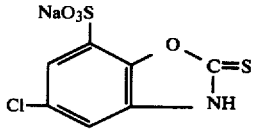 |
| 1.11 | 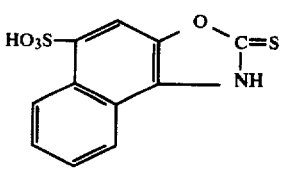 |

From U.S. Pat. Nos. 4,183,756 and 4,225,666 it is already known to prepare spectrally sensitized silver halide grains by the addition of a methine spectral sensitizing dye to a reaction vessel in which the silver halide grains are formed.

Hill U.S. Pat. No. 2,735,766, issued Feb. 21, 1956, discloses that photographic spectral sensitizing dye wandering can be eliminated or reduced by introducing a merocyanine spectral sensitizing dye during silver halide precipitation. Hill teaches to blend the spectral sensitizing dye with either the silver salt or the halide salt prior to bringing these salts together to form silver halide. Hill specifically states that the teachings do not extend to other optical sensitizing dyes, such as those of the carbocyanine class.

Philippaerts U.S. Pat. No. 3,628,960, issued Dec. 21, 1971, in discussing methine dye spectral sensitization of a blended emulsion states that the dyes can be incorporated in a separate addition or can be added as a mixture with one or more ingredients used in the formation of the different silver halide grains, during physical or chemical ripening or during another step preceding the coating of the emulsion. But these patents do not teach to prepare a more soluble emulsion in the presence of a growth inhibiting compound and to precipitate this emulsion on a less soluble silver halide emulsion.

The following are examples of suitable silver halide solvents: Halides, preferably alkali metal and ammonium halides, in particular bromides or chlorides; ammonia; thiocyanates, in particular alkali metal or ammonium thiocyanates; sulphites, in particular alkali metal or ammonium sulphites, thiosulphate; organic amines; thioethers and imidazole derivatives. Organic thioethers are used in a preferred embodiment of the invention. Suitable thioethers have been described in, for example, U.S. Pat. Nos. 3,271,157; 3,507,657; 3,531,289 and 3,574,628. Particularly suitable thioethers have also been described in German Offenlegungsschrift No. 2,824,249 and U.S. Pat. No. 4,057,429. Particularly suitable thioethers correspond to the following General formulae:

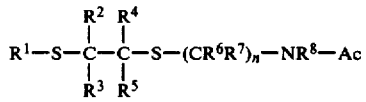

(A)

in which $R^1$ represents an aliphatic or cycloaliphatic aryl or aralkyl group;

$R^2$, $R^3$, $R^4$, $R^5$, $R^6$ and $R^7$ which may be the same or different represent hydrogen or alkyl;

$R^8$ represents hydrogen;

Ac represents an acyl group;

n=an integer having a value of at least 1.

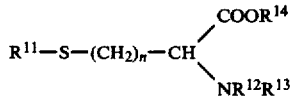

(B)

in which n an integer of from 1 to 5;

$R^{11}$ represents alkyl having 1 to 5 carbon-atoms;

$R^{12}$ represents hydrogen, alkyl having 1 to 5 carbon-atoms or an acyl group derived from a carboxylic acid;

$R^{13}$ represents hydrogen or alkyl having 1 to 5 carbon-atoms;

$R^{14}$ represents hydrogen, alkyl having 1 to 5 carbon atoms, aryl or a salt-forming cation.

Suitable imidazole derivatives have been described in German Offenlegungsschrift No. 2,758,711. Imidazoles corresponding to the following general formula C are particularly suitable:

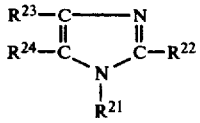

(C)

in which $R^{21}$, $R^{22}$, $R^{23}$ and $R^{24}$ which may be the same or different represent hydrogen or a substituted or unsubstituted alkyl, alkenyl, aryl or aralkyl group.

Particularly suitable solvents are listed in Table 2:

TABLE 2

| Number | Compound |
|---|---|
| 2.1 | Methionine |
| 2.2 | $CH_3—S[CH_2]_2—S—[CH_2]_2—NH—CO—NH_2$ |
| 2.3 | Imidazole |
| 2.4 | $NH_4Br$ |

Emulsion I is a fine grained emulsion and preferably has an average grain diameter <0.25 μm, is particular <0.1 μm. Emulsions of this type, also known as Lippmann emulsions, may be prepared by known methods. Suitable methods have been described in, for example, P. Glafkides, Photographic Chemistry, Vol. 1 (1958), Fountain Press, London.

In a preferred embodiment, these emulsions are prepared by the double jet process.

The growth inhibiting compounds to be used according to the invention in the preparation of the emulsion I may be added to emulsion I at any stage of its preparation. According to a preferred embodiment, they are added to the reaction mixture in which emulsion I is precipitated, but they may also be added to the starting solutions, in particular to the starting solution containing halide. The quantities to be used depend on the desired final size of the silver halide crystals of emulsion I and are generally within the range of from 0.2 g to 10 g per mol of silver halide. The halide composition of emulsion I may be varied within wide limits, depending on the halide composition desired in the finished emulsion. Particularly suitable halides are silver chloride, silver bromide and mixtures thereof, which may have an iodide content of <35 mol %, preferably <10 mol %.

Emulsions of type II to be used according to the invention generally have an average grain diameter <0.1 μm, in particular <0.20 μm. In a preferred embodiment, they have an average grain diameter <0.25 μm.

The halide composition and the habit of the grains of emulsion II may be varied within wide limits and range from silver chloride, silver chlorobromide, silver bromide, silver chloroiodobromide and silver iodobromide to pure silver iodide emulsions. The emulsions may be prepared by known methods. Both monodisperse and heterodisperse emulsions may be used.

If silver halide emulsions having a higher internal sensitivity are required, emulsion II may be chemically ripened in known manner before precipitation of emulsion I. This ripening may be achieved by, for example, the addition of compounds containing sulphur, the addition of reducing agents or the addition of noble metals or noble metal compounds; as described in U.S. Pat. No. 3,206,313.

In a preferred embodiment, emulsion II is first prepared as a preliminary precipitate which may, if desired, be concentrated and desalted. The further addition of substance, which according to the invention is carried out by the addition of emulsion I, may be arranged so that more than 50 mol %, preferably more than 80 mol % of the silver halide put into the process is added in the form of emulsion I. Emulsion I may also be concentrated and desalted.

The addition of emulsion I and of the silver halide solvents to be used according to the invention may in principle be carried out either simultaneously or at different times, all at once or in several portions or continuously. The concentrations at which silver halide emulsions I and II are used may vary within wide limits, as may also the other parameters of solution and recrystallisation, such as the pAg, pH, temperature and solution time. The temperature is advantageously in the range of 40° C. to 80° C. and the solution time from 5 minutes to 90 minutes. The quantity of silver halide solvent to be used according to the invention can easily be determined by a series of experiments and is preferably from 0.1 g to 50 g per mol of silver halide used, preferably from 0.5 to 50 g per mol of silver halide.

It was surprising to find that fine grained emulsions which were prepared in the presence of growth inhibiting substances could nevertheless be used for solution and recrystallisation and even resulted in improved sensitometric properties compared with those obtained with emulsions which had been prepared without growth inhibiting substances.

Emulsions for a wide variety of photographic materials may be prepared according to the invention e.g. negative emulsions with high surface sensitivity; negative emulsions with high internal sensitivity; direct positive emulsions with or without surface fog; emulsions with a layered grain structure, print out emulsions; reversal emulsions; emulsions for black-and-white materials and for colour photographic materials, and emulsions with a specified grain distribution and halide topography, in particular with a specified halide gradient, in particular an iodide gradient.

The silver halide emulsions prepared according to the emulsion may consist of pure silver halides or of mixtures of different silver halides. The silver halide grains of the emulsions may, of course, consist of silver chloride, silver bromide, silver iodide, silver chlorobromide, silver iodochloride, silver iodobromide and silver iodochlorobromide.

The silver halide emulsions prepared according to the invention and the starting emulsions I and II may be treated in known manner to remove the water-soluble salts, for example they may be solidified, shredded and washed or they may be coagulated with a coagulating agent and washed, for example as disclosed in U.S. Pat. No. 4,057,429.

The emulsion prepared according to the invention and optionally also the starting emulsions, in particular emulsion II, may be chemically sensitized, e.g. by the addition of sulphur compounds such as allyl isothiocyanate, allylthiourea or sodium thiosulphate at the stage of chemical ripening. Reducing agents may also be used as chemical sensitizers, e.g. the tin compounds described in Belgian Pat. Nos. 493,464 and 568,687; polyamines such as diethylene triamine or aminomethylsulphinic acid derivatives, e.g. according to Belgian Pat. No. 547,323.

Noble metals such as gold, platinum, palladium, iridium, ruthenium or rhodium and compounds of such metals are also suitable chemical sensitizers. This method of chemical sensitization has been described in the article by R. Koslowsky, Z.Wiss.Phot. 46, 65–72 (1951).

The emulsions may also be sensitized with polyalkylene oxide derivatives, e.g. with a polyethylene oxide having a molecular weight of from 1000 to 20000, or with condensation products of alkylene oxides and aliphatic alcohols, glycols, cyclic dehydration products of hexitols, alkyl substituted phenols, aliphatic carboxylic acids, aliphatic amines, aliphatic diamines and amides. The condensation products have a molecular weight of at least 700, preferably more than 1000. These sensitizers may, of course, be combined to produce special effects, as described in Belgian Pat. No. 537,278 and British Pat. No. 727,982.

The emulsions may also be optically sensitized, e.g. with the usual polymethine dyes such as neutrocyanines, basic or acid carbocyanines, rhodacyanines, hemicyanines, styryl dyes, oxonoles and the like. Sensitizers of this kind have been described in the work by F. M. Hamer entitled "The Cyanine Dyes and related Compounds", 1964, Interscience Publishers, John Wiley and Sons.

The emulsions may contain the usual stabilizers, e.g. homopolar or salt-type compounds of mercury containing aromatic or heterocyclic rings, such as mercaptotriazoles, or simple mercury salts, sulphonium mercury double salts and other mercury compounds. Azaindenes are also suitable stabilizers, particularly tetra- or pentaazaindenes, especially those which are substituted with hydroxyl or amino groups. Compounds of this kind have been described in the article by Birr. Z.Wiss.Phot. 47 (1952), 2–58. Other suitable stabilizers include, inter alia, heterocyclic mercapto compounds, e.g. phenylmercaptotetrazole, quaternary benzothiazole derivatives and benzotriazole.

According to the invention, it is advantageous to use gelatine as binder or protective colloid for the photographic emulsion according to the invention, although other colloids may also be used, for example various synthetic hydrophilic materials having a high molecular weight, e.g. graft polymers of gelatine and other materials having a high molecular weight; proteins such as albumen, casein and the like; cellulose derivatives such as hydroxyethylcellulose, carboxymethylcellulose, cellulose sulphate and the like; saccharide derivatives such as sodium alginate, starch derivatives and the like; homopolymers or copolymers such as polyvinyl alcohol, partially acetalised polyvinyl alcohol, poly-N-vinylpyrrolidone, polyacrylic acid, polymethacrylic acid, polyacrylamide, polyvinylimidazole and polyvinylpyrazole.

Suitable gelatine graft polymers for the process according to the invention include those obtained by grafting hompolymers or copolymers of vinyl monomers such as acrylic acid, methacrylic acid or derivatives thereof such as esters, amides or the like or acrylonitrile, styrene or the like on gelatine. Graft polymers of gelatine with polymers which are to a certain extent compatible with gelatine are particularly preferred, e.g. polymers of acrylic acid, methacrylic acid, acrylamide, methacrylamide and hydroxyalkylmethacrylates.

The emulsions may be hardened in the usual manner, for example with formaldehyde or halogen-substituted aldehydes containing a carboxyl group, such as mucobromic acid, diketones, methane sulphonic acid esters and dialdehydes.

The photographic layers may also be hardened with epoxide type, heterocyclic ethylene imine or acryloyl hardeners. Examples of such hardeners have been described e.g. in German Offenlegungsschrift No. 2,263,602 or British Pat. No. 1,266,655. The layers may also be hardened by the process of German Offenlegungsschrift No. 2,218,009 to produce colour photographic materials suitable for high temperature processing.

The photographic layers or colour photographic multilayered materials may also be hardened with diazine, triazine, or 1,2-dihydroquinoline hardeners, as described in British Pat. Nos. 1,193,290; 1,251,091; 1,306,544 or 1,266,655; French Pat. No. 7,102,716 or German Offenlegungsschrift No. 2,332,317. Examples of such hardeners include diazine derivatives containing alkylsulphonyl or arylsulphonyl groups, derivatives of hydrogenated diazines or triazines, e.g. 1,3,5-hexahydrotriazine, fluorosubstituted diazine derivatives such as fluoropyrimidine, or esters of 2-substituted 1,2-dihydroquinoline- or 1,2-dihydroisoquinoline-N-carboxylic acids. Vinyl sulphonic acid hardeners, carbodiimide hardeners and carbamoyl hardeners are also suitable, e.g. those described in German Offenlegungsschriften Nos. 2,263,602; 2,225,230 and 1,808,685; French Pat. No. 1,491,807; German Pat. No. 872,513 and DDR Pat. No. 7218. Other suitable hardeners have been described, for example in British Pat. No. 1,268,550.

The present invention may be used for the production of both black-and-white images and colour photographic images. Colour photographic images may be produced by the known method of chromogenic development in the presence of colour couplers which react with the oxidation product of colour producing p-phenylenediamine developers to form dyes.

The colour couplers may be added to the colour developer. But according to a preferred embodiment, the photographic material itself contains the usual colour couplers, generally incorporated in the silver halide layers. The red-sensitive layer, for example, may contain a non-diffusible colour coupler to produce the cyan partial colour image, generally a phenol or α-naphthol coupler. The green-sensitive layer may contain, for example, at least one non-diffusible colour coupler to produce the magenta partial colour image, these colour couplers being generally of the 5-pyrazolone series or imidazolone series. The blue-sensitive layer may contain, for example, a non-diffusible colour coupler for the production of the yellow partial colour image, generally a colour coupler having an open chain keto methylene group. Colour couplers of this type are known in large numbers and have been described in many Patent Specifications. Reference may be made, for examples, to the publication "Farbkuppler" by W. Pelz in "Mitteilungen aus den Forschungslaboratorien der Agfa, Leverkusen Munchen", Volume III (1961) and the publication by K. Venkataraman in "The Chemistry of Synthetic Dyes" Vol. 4, 341–387, Academic Press, 1971.

2-Equivalent couplers may also be used as non-diffusible colour couplers. These contain a substituent which can be split off in the coupling position so that, in contrast to the usual 4-equivalent couplers they require only two equivalents of silver halide for colour formation. Suitable 2-equivalent couplers include, for example, the known DIR couplers in which the group which can be split off is liberated as diffusible development inhibitor after reaction with colour developer oxidation products. So-called white couplers may also be used to improve the properties of the photographic material.

The non-diffusible colour couplers and colour producing compounds are added to the light-sensitive silver halide emulsions or other casting solutions by the usual known methods. If the compounds are soluble in water or alkalies, they may be added to the emulsions in the form of aqueous solutions, to which water-miscible organic solvents such as ethanol, acetone or dimethylformamide may be added. Where the non-diffusible colour couplers and colour producing compounds are insoluble in water and alkalies, they may be emulsified in known manner, e.g. by mixing a solution of these compounds in a low boiling or organic solvent directly with the silver halide emulsion or first mixing it with an aqueous gelatine solution and then removing the organic solvent in the usual manner. An emulsion of the given compound in gelatine obtained in this manner is subsequently mixed with the silver halide emulsion. So-called coupler solvents or oil formers may also be used to assist emulsification of such hydrophobic compounds. These coupler solvents or oil formers are generally relatively high boiling organic compounds in which the non-diffusible compounds releasing colour couplers and development inhibitors, which are required to be emulsified in the silver halide emulsion, are enclosed in the form of oily droplets. Reference may be made in this connection to, for example, U.S. Pat. Nos. 2,322,027; 2,533,514; 3,689,271; 3,764,336 and 3,765,897.

The emulsions prepared according to the invention may be applied to the usual support layers e.g. to substrates of cellulose esters such as cellulose acetate or cellulose acetobutyrate, to polyesters, in particular polyethylene terephthalate or polycarbonates, and in particular to substrates based on bis-phenylolpropane. Paper substrates which may contain water-impermeable polyolefine layers e.g. of polyethylene or polypropylene, and glass or metal substrates may also be used.

The usual black-and-white developer compounds are suitable for black-and-white development, e.g. hydroxybenzenes and 3-pyrazolidones. The usual colour developer substance may be used for the production of colour images, e.g. N,N-dimethyl-p-phenylenediamine; 4-amino-3-methyl-N-ethyl-N-methoxyethylaniline; 2-amino-5-diethylaminotoluene; N-butyl-N-ω-sulphobutyl-p-phenylenediamine; 2-amino-5-(N-ethyl-N-β-methanesulphonamidoethyl-amino)-toluene; N-ethyl-N-β-hydroxyethyl-p-phenylenediamine; N,N-bis-(β-hydroxyethyl)-p-phenylenediamine and 2-amino-5-(N-ethyl-N-β-hydroxyethylamino)-toluene. Other suitable colour developers have been described, for example in J.Amer.Chem.Soc. 73, 3100 (1951).

EXAMPLE 1

A sparingly soluble emulsion II and a more readily soluble emulsion I are first prepared in accordance with the data given in Table 3 below. Emulsion II is a silver bromide emulsion containing 10 mol % of silver iodide. It is prepared in known manner by a pAg controlled double jet process according to British Pat. No. 1,027,146 and is homodisperse. It contains 1.25 mol of silver halide per kg and 40 g of gelatine per kg. The same emulsion II is used in all of the samples shown in Table 3. The more readily soluble emulsion I is a pure silver bromide emulsion prepared by a pAg controlled double jet process. It contains 1.25 mol of silver halide per kg and 28 g of gelatine per kg. When preparing this emulsion, the growth inhibitors indicated in Table 3 are added before precipitation to the gelatine solution.

3000 g of emulsion I are in each case mixed with 500 g of emulsion II and digested in the presence of the solvents indicated in Table 3 until solution and recrystallisation has been completed.

The emulsion is then coagulated, washed and finally redispersed with the addition of water and gelatine in known manner and chemically sensitized in the usual manner. The finished emulsions indicated in Table 3 have a narrow grain size distribution.

To determine the sensitometric properties, a sample of the emulsion is coated on a suitable substrate after the addition of 20 ml of a 1% aqueous solution of 4-hydroxy-6-methyl-1,3,3a,7-tetraazaindene, 35 ml of a 7.5% aqueous solution of saponin and 35 ml of a 2% aqueous solution of mucochloric acid per kg of emulsion sample. The photographic material obtained is exposed imagewise through a grey wedge in the usual manner and developed for 7 minutes in the following developer at 20° C.:

| Developer | |
|---|---|
| Ethylene diaminotetracetic acid | 1.5 g |
| Sodium hexametaphosphate | 1 g |
| Sodium sulphite, sicc. | 60 g |
| Borax | 15 g |
| Potassium bromide | 3 g |
| Hydroquinone | 6 g |
| 1-phenyl-3-pyrazolidone | 0.7 g |
| made up to 1 l with water. | |

The results shown in Table 3 are obtained.

TABLE 3

| Sample No. | emulsion I: growth inhibitor Compound | emulsion I: growth inhibitor g/mol of silver halide | emulsion I: Average particle diameter of emulsion I (μm) | Solvent Compound | Solvent g/mol of silver halide | finished emulsion S | finished emulsion F | finished emulsion Average particle diameter of finished emulsion (μm) |
|---|---|---|---|---|---|---|---|---|
| 1 | — | — | 0.06 | 2.4 | 30 | 100 | 0.19 | 0.54 |
| 2+ | 1.1 | 0.34 | 0.05 | 2.4 | 30 | 115 | 0.14 | 0.54 |
| 3+ | 1.2 | 1.13 | 0.05 | 2.4 | 30 | 105 | 0.15 | 0.53 |
| 4 | — | — | 0.06 | 2.1<br>2.4 | 7.5<br>15 | 115 | 0.12 | 0.45 |
| 5+ | 1.1 | 0.34 | 0.05 | 2.1<br>2.4 | 7.5<br>15 | 125 | 0.12 | 0.46 |
| 6 | — | — | 0.06 | 2.2<br>2.4 | 0.75<br>15 | 185 | 0.20 | 0.80 |
| 7+ | 1.2 | 1.13 | 0.05 | 2.2<br>2.4 | 0.75<br>15 | 217 | 0.16 | 0.80 |
| 8 | — | — | 0.06 | 2.1<br>2.4 | 8.1<br>14.5 | 220 | 0.15 | 0.86 |
| 9 | 1.3 | 0.25 | 0.05 | 2.1<br>2.4 | 8.1<br>14.5 | 218 | 0.12 | 0.75 |

+ = Samples according to the invention
S = Relative speed, double the numerical value corresponding to double the speed
F = Fog Samples 2, 3, 5, 7 and 9 are in accordance with the invention and, compared with comparison samples which have been prepared without growth inhibitors, they show a surprising improvement in the speed/particle size/fog relation.

We claim:

1. A process for the preparation of a silver halide emulsion in which a fine-grained silver halide emulsion I is blended in the presence of at least one silver halide solvent with a silver halide emulsion II which is less soluble than said emulsion I and in which the blend is held for a sufficient time to effect redissolving of emulsion I and precipitation on emulsion II wherein emulsion I has been prepared by reaction of a soluble silver salt and a soluble halide in the presence of at least one compound inhibiting grain growth.

2. Process according to claim 1, wherein the compound which inhibits grain growth is a purine base or a compound corresponding to the following formula

Z—A—X in which

Z and X, which may be the same or different, each represents a heterocyclic group, a substituted heterocyclic group or a heterocyclic group with condensed ring attached, the heterocyclic group containing a =N— group, and A represents a single chemical bond, an alkylene group which may be interrupted by an oxygen atom or by a —N(R) group in which R represents a hydrogen atom or an alkyl group having at the most 4 carbon atoms, an arylene group, an alkenylene group or a S-alkylene —S— or S-alkylene group in which the alkylene groups may be interrupted by an oxygen atom or a N(R) group in which R has the same meaning as above, or a silver halide sensitizing dye or a compound of one of the following formulae

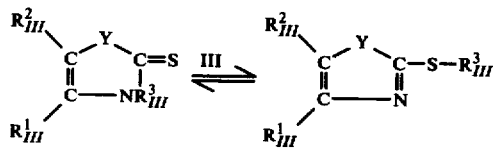

wherein

Y represents —O—, —S— or —$NR_{III}^4$—

$R_{III}^1$, $R_{III}^2$ which may be the same or different, represent H, alkyl with 1-4 carbon atoms, aryl, or together the atoms for completing an annellated aromatic system, which may be substituted $R_{III}^3$ represents H or an alkylene group substituted by a N-containing 5-or 6 membered heterocyclic ring, $R_{III}^4$ represents an alkyl rest or an aryl rest, or H.

3. A process according to claim 1 wherein the sensitizing dye corresponds to the following formula II

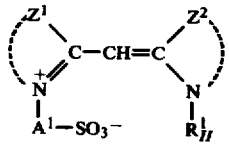

II wherein $Z^1$ represents a group of atoms necessary to complete a benzothiazole nucleus or a naphthothiazole nucleus $Z^2$ represents a group of atoms necessary to complete a naphthothiazole nucleus $A^1$ represents an alkylene group having 4 or less carbon atoms which can be substituted with a hydroxyl group $R_{III}^1$ represent an $—A^2—SO_3H$ group or an $—A^2—CO_2H$ group, wherein $A^2$ has the same meaning as $A^1$, and $A^1$ can be the same or different.

4. Process according to claim 1, wherein the silver alide solvent used is an ammonium halide, a thioether r an imidazole.

5. Process accordiang to claim 4, wherein at least one f the following compounds is used as silver halide olvent:

(a) ammonium bromide (b) a compound corresponding to the following formula

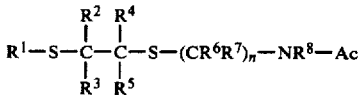

in which $R^1$ represents aliphatic, cyclialiphatic aryl or aralkyl group;

$R^2$, $R^3$, $R^4$, $R^5$, $R^6$, $R^7$ which may be the same or different, represent hydrogen or alkyl;

$R^8$ represents hydrogen,

Ac represents an acyl group;

n = an integer having a value of at least 1;

(c) a compound corresponding to the following formula:

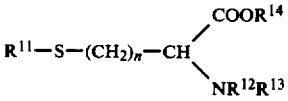

in which n = an integer of from 1 to 5;

$R^{11}$ represents alkyl having 1 to 5 carbon-atoms;

$R^{12}$ represents hydrogen, alkyl having 1 to 5 carbon-represents hydrogen, alkyl having 1 to 5 carbon-atoms or an acyl group derived from a carboxylic acid;

$R^{13}$ represents hydrogen or an alkyl group having 1 to 5 carbon atoms;

$R^{14}$ represents hydrogen, alkyl having 1 to 5 carbon atoms, aryl or a salt forming cation;

(d) a compound corresponding to the following formula

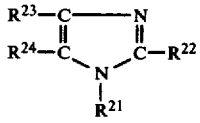

in which $R^{21}$, $R^{22}$, $R^{23}$, $R^{24}$ which may be the same or different, represent hydrogen and/or a substituted or unsubstituted alkyl, alkenyl, aryl or aralkyl group.

6. Process according to claim 4, wherein the silver halide solvent used is ammonium bromide, methionine or a compound corresponding to the following formula:

$$CH_3\text{-}S—CH_2]_2S[CH_2]_2NH—CO—NH_2$$

and wherein the compound inhibiting grain growth is one of the following compounds

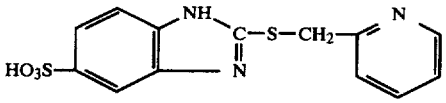

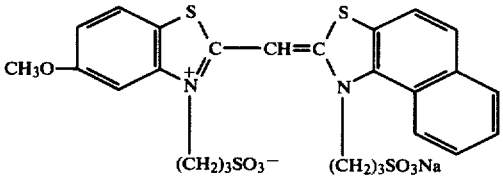

7. Process according to claim 1, wherein the average grain diameter of emulsion I is less than 0.25 μm and the average grain diamter of emulsion II is greater than 0.25 μm.

8. Light-sensitive photographic recording material comprising a support layer and at least one light-sensitive silver halide emulsion, wherein the silver halide emulsion of this layer has been prepared according to claim 1.

9. Material according to claim 8, which contains colour couplers.

10. Process for the production of photographic images by imagewise exposure and development of a material according to claim 8.

* * * * *